US006502327B2

(12) United States Patent
Kume et al.

(10) Patent No.: US 6,502,327 B2
(45) Date of Patent: Jan. 7, 2003

(54) STERILIZING LIQUID REMOVER

(75) Inventors: Satoshi Kume, Tokushima-ken (JP); Hiroshi Katayama, Tokushima-ken (JP); Shigenori Tawa, Tokushima-ken (JP); Michio Ueda, Tokushima-ken (JP)

(73) Assignee: Shikoku Kakoki Co., Ltd., Tokushima (JP)

( * ) Notice: Subject to any disclaimer, the term of this patent is extended or adjusted under 35 U.S.C. 154(b) by 0 days.

(21) Appl. No.: 09/919,869

(22) Filed: Aug. 2, 2001

(65) Prior Publication Data

US 2002/0020143 A1 Feb. 21, 2002

(30) Foreign Application Priority Data

Aug. 8, 2000 (JP) ..... 2000-239520

(51) Int. Cl.[7] ..... F26B 5/14

(52) U.S. Cl. ..... 34/399; 34/464; 34/69; 34/643; 34/644; 422/28

(58) Field of Search ..... 34/397, 398, 399, 34/400, 414, 444, 464, 69, 70, 634, 639, 643, 644; 422/28, 33; 134/64 R, 122 R, 199

(56) References Cited

U.S. PATENT DOCUMENTS

| | | | | | |
|---|---|---|---|---|---|
| 3,689,147 | A | * | 9/1972 | Suzuki | 355/10 |
| 3,929,409 | A | * | 12/1975 | Buchner et al. | 21/91 |
| 3,968,571 | A | * | 7/1976 | Oschatz et al. | 34/14 |
| 4,653,197 | A | * | 3/1987 | Koba | 34/23 |
| 4,924,891 | A | * | 5/1990 | Soubrier | 134/64 R |
| 5,404,654 | A | * | 4/1995 | Babinsky et al. | 34/122 |
| 5,424,034 | A | * | 6/1995 | Hilmersson | 422/28 |
| 5,669,159 | A | * | 9/1997 | Orloff et al. | 34/398 |
| 6,134,811 | A | * | 10/2000 | Berger et al. | 34/618 |
| 6,354,061 | B1 | * | 3/2002 | Bellei et al. | 53/167 |

FOREIGN PATENT DOCUMENTS

| | | |
|---|---|---|
| EP | 0 286 276 | 10/1988 |
| JP | 44-20556 | 9/1969 |
| JP | 8-58740 | 3/1996 |
| JP | 10-114311 | 5/1998 |
| JP | 11-348937 | 12/1999 |

* cited by examiner

*Primary Examiner*—Ira S. Lazarus
*Assistant Examiner*—K. B. Rinehart
(74) *Attorney, Agent, or Firm*—Armstrong, Westerman & Hattori, LLP

(57) ABSTRACT

An object of the present invention is to provide a sterilizing liquid remover and a method of removing the sterilizing liquid which can easily remove/dry the sterilizing liquid which remains at the step portion formed by the sealing tape and the web which forms the container's interior side in the packing material web having the sealing tape adhered to its side end portion. Driblets on the surface of the web are squeezed by squeeze rollers 30 disposed such that they can open and close while sandwiching the transfer route of the web W having the sealing tape adhered to its side end portion therebetween, the heated air is blasted at the step portion formed by the sealing tape and the web by the second air knife 20, then the heated air is blasted at the whole width of both faces of the web by the first air knives 10, and the sterilizing liquid is removed. The remaining blown driblets at the step portion can be also removed by the second air knife 20 which can blast the heated air widely and laterally at the step portion.

15 Claims, 4 Drawing Sheets

STERILIZING LIQUID REMOVER

BACKGROUND OF THE INVENTION

1. Field of the Invention

The present invention relates to an apparatus and a method for removing a sterilizing liquid from a packing material web in a filling/packing machine or other such machine which manufactures liquid packing containers from the web, and more particularly to an apparatus and a method of removing sterilizing liquid from the web in the filling/packing machine or other such machine which manufactures the liquid packing containers by a method comprising the steps of: sterilizing the packing material web having a sealing tape adhered to its side end portion by soaking the web in the sterilizing liquid such as aqueous hydrogen peroxide or the like, removing the sterilizing liquid from the web, gradually forming the web into a tubular shape and adhering its longitudinal both ends to each other while filling a liquid inside, then hermetically sealing and cutting the web at the length corresponding to one container, and shaping the web.

2. Description of Related Art

A filling/packing machine which manufactures liquid packing containers from a packing material web usually has a sterilizing liquid tank for sterilizing the web, and the web sterilized by being soaked in the sterilizing liquid tank is taken out of the sterilizing liquid tank and then the sterilizing liquid which adheres to the web is removed. As the apparatuses for removing the sterilizing liquid from the web, there are known apparatuses such as: an apparatus in which driblets on the surface of a web are squeezed while the web is made to pass through a pair of rubber rollers called squeeze rollers which can rock freely, an apparatus in which a hot and high-speed air is blasted at a web from an air knife and driblets on the surface of the web are blown off (Japanese Patent Publication No. 44-20556), an apparatus in which driblets on the surface of a web are evaporated, while the web is made to pass through a narrow gap between two partitioned rooms, and by blasting a hot and high-speed air into one of the rooms during the passing (Japanese Laid-Open Patent Application No. 8-58740), and an apparatus in which the above-stated methods are used together.

Some modifications have been made to the above-mentioned apparatuses for removing the sterilizing liquid from the web. In Japanese Laid-Open Patent Application No. 10-114311, there is a description of a web sterilizing liquid remover having a sterilizing liquid tank, a web transfer means for introducing a web into the sterilizing liquid tank, soaking the introduced web in a sterilizing liquid in the sterilizing liquid tank, and then taking out the web from the sterilizing liquid tank, and a pair of squeeze rollers disposed so that it can open and close while sandwiching the transfer route of the web taken out of the sterilizing liquid tank therebetween, where one of the two squeeze rollers is arranged to be a fixed roller and the other is arranged to be a movable roller in order to locate the both rollers precisely at a closed position. Further, in Japanese Laid-Open Patent Application No. 11-348937, there is a description of a method of removing a liquid on the surface and in a recess of the packing material and a liquid remover, where a blast nozzle for blasting an air only at the recess is disposed on this side of a squeeze roller for conveying the packing materials, at the position where the recess of the packing material passes, and an air knife section for blasting the air at the whole width of the packing materials is disposed behind the squeeze roller, and the air knife and a blast pipe having the blast nozzle are connected communicatively, consequently, a sterilant in the recess of the packing material is removed concentratedly and the sterilant adhering to the whole surface of the packing materials can be removed efficiently and uniformly by the following blast from the air knife section.

SUMMARY OF THE INVENTION

Objects of the Invention

In manufacturing liquid beverages which are packed in paper containers for long-term storage from a packing material web, an oxygen-impermeable or a water-impermeable sealing tape is adhered to the side end portion of the web in order to prevent an air from permeating into the container through an end face of the web in contact with the content of a vertical heat-sealing portion where the both longitudinal ends of the web are adhered to each other by heat-sealing, or to prevent the content from permeating through an end face of the web in contact with the content of a vertical heat-sealing portion adhered. The packing material web having the sealing tape adhered to its side end portion has been soaked in the sterilizing liquid in the sterilizing liquid tank, and then taken out of the sterilizing liquid tank, and the sterilizing liquid adhering to the surface of the web has been removed and dried by a conventional sterilizing liquid remover with a squeeze roller and an air knife. It has been found that, however, because of high transfer speed of the web in recent high-speed filling/packing machines, the conventional sterilizing liquid remover cannot remove/dry the sterilizing liquid sufficiently at a step portion formed by the sealing tape and the web which forms the container's interior side, and therefore, a problem that the sterilizing liquid remains at the step portion has arisen. An object of the present invention is to provide a sterilizing liquid remover and a method of removing the sterilizing liquid which can easily remove/dry the sterilizing liquid which remains at the step portion formed by the sealing tape and the web which forms the container's interior side in a packing material web having a sealing tape adhered to its side end portion.

Means to Attain the Object

The inventors of the present invention conducted diligent research aimed at attaining the above-mentioned object. First, as a method which does not change the design of the conventional sterilizing liquid remover, some experiments, where the hardness of surface material rubber of the squeeze roller was changed to be softer, the amount of the wind from an air knife was increased, or the temperature of the wind from the air knife was raised, were conducted. However, satisfactory results could not be obtained. Next, as a method which partially changes the design of the conventional sterilizing liquid remover, an experiment using a second air knife having a small and round opening which can dry and remove the sterilizing liquid remaining at the step portion formed by the sealing tape and the web which forms the container's interior side locally was conducted. It was found that the sterilizing liquid remaining at the step portion could be removed to some extent by using the second air knife together, however, a phenomenon, where the sterilizing liquid blown by the second air knife forms driblets and adheres to or trickles down on the surface of the web away from the step portion, was often observed. Though the cause of the phenomenon is unknown, it has been found that it is effective to use the second air knife having a wide opening which covers said step portion laterally, in particular, to dispose the second air knife between a pair of air knives and squeeze rollers for removing the sterilizing liquid brought about by the phenomenon, and the present invention has been completed.

The present invention relates to a sterilizing liquid remover characterized in comprising: squeeze rollers for squeezing driblets on the surface of a web, disposed such that they can open and close while sandwiching the transfer route of the web having a sealing tape adhered to its side end portion therebetween; first air knives being able to blast a heated air at least to the whole width of the web which forms the container's interior side, disposed downstream of the squeeze roller in a web transfer direction; a second air knife being able to blast the heated air at a step portion formed by the sealing tape and the web which forms the container's interior side, disposed upstream of the first air knife in the web transfer direction (first aspect), the sterilizing liquid remover according to the first aspect, wherein the first air knives are a pair of air knives disposed such that they can open and close while sandwiching the transfer route of the web therebetween (second aspect), the sterilizing liquid remover according to the first and second aspects, wherein the second air knife is disposed between the first air knife and the squeeze roller (third aspect), the sterilizing liquid remover according to any one of the first to third aspects, wherein the second air knife has a wide opening which laterally covers the step portion formed by the sealing tape and the web which forms the container's interior side (fourth aspect), the sterilizing liquid remover according to anyone of the first to fourth aspects, wherein the second air knife is disposed such that the web heated by the second air knife reaches the first air knife before cooling down (fifth aspect), the sterilizing liquid remover according to any one of the first to fifth aspects, wherein the second air knife is fixed to the same rotary axis as the first air knife which can blast the heated air at the whole width of the container's interior side of the web (sixth aspect), the sterilizing liquid remover according to any one of the first to sixth aspects, wherein the second air knife and the first air knife which can blast the heated air at the whole width of the container's interior side of the web are connected communicatively (seventh aspect), and the sterilizing liquid remover according to any one of the first to seventh aspects, wherein driblets on the surface of the web and squeezed by the squeeze rollers are the driblets on the surface of the web which is introduced into a sterilizing liquid tank and soaked into the sterilizing liquid therein, and taken out of the sterilizing liquid tank (eighth aspect).

The present invention also relates to a method of removing the sterilizing liquid characterized by that the heated air is blasted at the step portion formed by the sealing tape and the web which forms the container's interior side by the second air knife disposed upstream of the web transfer direction of the first air knife in a method of removing the sterilizing liquid comprising the steps of: squeezing the driblets on the surface of the web by the squeeze rollers disposed such that they can open and close while sandwiching the transfer route of the web having the sealing tape adhered to its side end portion therebetween, and blasting the heated air at least at the whole width of the container's interior side of the web by the first air knife disposed downstream of the web transfer direction of the squeeze roller (ninth aspect), the method of removing the sterilizing liquid according to the ninth aspect, wherein the heated air is blasted at the both faces of the web by the first air knives (tenth aspect), the method of removing the sterilizing liquid according to the ninth to tenth aspects, wherein the heated air at a speed of 15~25 m/s and with a temperature of 90~110° C. is blasted by the first air knife (eleventh aspect), the method of removing the sterilizing liquid according to any one of the ninth to eleventh aspects, wherein the driblets on the surface of the web are squeezed by the squeeze rollers and then the heated air is blasted at the step portion formed by the sealing tape and the web which forms the container's interior side by the second air knife (twelfth aspect), the method of removing the sterilizing liquid according to any one of the ninth to twelfth aspects, wherein the heated air is blasted widely and laterally at the step portion formed by the sealing tape and the web which forms the container's interior side by the second air knife (thirteenth aspect), the sterilizing liquid remover according to any one of the ninth to thirteenth aspects, wherein the web heated by the second air knife is blasted the heated air by the first air knife before cooling down (fourteenth aspect), the method of removing the sterilizing liquid according to any one of the ninth to fourteenth aspects, wherein the heated air at a speed of 18~28 m/s and with a temperature of 90~110° C. is blasted by the second air knife (fifteenth aspect), and the method of removing the sterilizing liquid according to any one of the ninth to fifteenth aspects, wherein the wind speed of the second air knife is always faster than that of the first air knife (sixteenth aspect).

Figure 1:
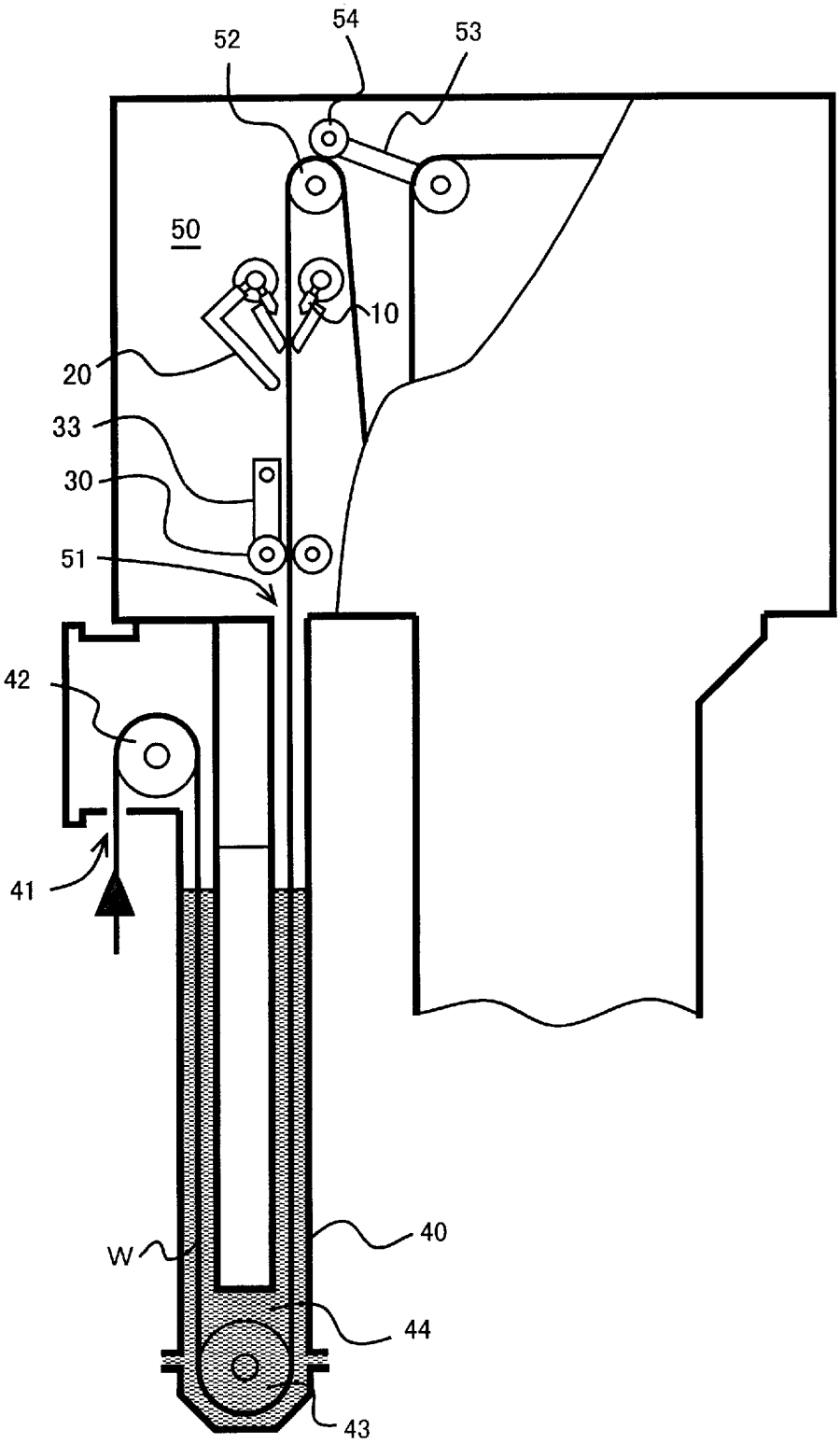
FIG. 1 is a vertical sectional view showing the sterilizing liquid remover of the present invention or a part of the filling/packing machine having the sterilizing liquid remover of the present invention.

The reference characters represent as follows:

W: a web; S: a sealing tape; 10: a first air knife; 11: a horizontal air supply pipe; 12: a hollow band plate; 13: a blow-off opening; 14: a web guide; 15: a rotary axis; 20: a second air knife; 21: a communicatively connected pipe; 22: a blow-off pipe; 23: a blow-off slit; 30: a squeeze roller; 31 a roller axis; 32: a hollow; 33: a rocking arm; 40: a sterilizing liquid tank; 41: a web introducing opening; 42: an upper web guide roller; 43: a lower web guide roller; 44: a sterilizing liquid; 50: an aseptic chamber; 51: a web entrance; 52: a feed roller; 53: a vertical rocking left arm; 54: a press roller.

DETAILED DESCRIPTION OF THE INVENTION

Mode for Carrying out the Invention

The sterilizing liquid remover of the present invention is not limited particularly, as long as it comprises: squeeze rollers for squeezing the driblets on the surface of the web, disposed such that they can open and close while sandwiching the transfer route of the web having the sealing tape adhered to its side end portion therebetween; first air knives being able to blast the heated air at least at the whole width of the container's interior side of the web, disposed downstream of the web transfer direction of the squeeze roller; the second air knife being able to blast the heated air at the step portion formed by the sealing tape and the web which forms the container's interior side, disposed upstream of the web transfer direction of the first air knife. The method of removing the sterilizing liquid of the present invention is not limited particularly as long as it is a method wherein the heated air is blasted at the step portion formed by the sealing tape and the web which forms the container's interior side by the second air knife disposed upstream of the web transfer direction of the first air knife in a method of removing the sterilizing liquid comprising the steps of: squeezing the driblets on the surface of the web by the squeeze rollers disposed such that they can open and close while sandwiching the transfer route of the web having the sealing tape adhered to its side end portion therebetween, and blasting the heated air at least at the whole width of the container's interior side of the web by the first air knife disposed downstream of the web transfer direction of the squeeze roller.

The above-stated sterilizing liquid remover and the method of removing the sterilizing liquid of the present invention can be applied to a filling/packing machine or other such machine which manufactures liquid packing containers from a packing material web, and in particular, it is advantageous when it is applied to a high-speed filling/packing machine. The filling/packing machine usually has a sterilizing liquid tank and the web having a sealing tape adhered to its side end portion is introduced into the sterilizing liquid tank and soaked in the sterilizing liquid therein, then taken out of the sterilizing liquid tank. Driblets adhering to the surface of the web which is taken out of the sterilizing liquid tank are removed by the sterilizing liquid remover and the method of removing the sterilizing liquid of the present invention, and the driblets on the surface of the web, which are the objects of removal by the sterilizing liquid remover and the method of removing the sterilizing liquid of the present invention, are not particularly limited. These driblets could be formed through blast of the atomized sterilizing liquid, or through aggregation of the sterilizing liquid, which became gaseous form by vaporization, on the surface of the web, other than the driblets formed through the immersion in the sterilizing liquid.

The above-stated sterilizing liquid tank is not particularly limited as long as it can pool the sterilizing liquid for sterilizing the packing material web, and soak the web in the sterilizing liquid. For example, known sterilizing liquid tank described in the above-mentioned Japanese Laid-Open Patent Application No. 10-114311 is specifically exemplified. The sterilizing liquid remover of the present invention is usually disposed in an aseptic chamber which is connected/disposed air-tightly downstream of the web transfer direction of the sterilizing liquid tank. The above-stated sterilizing liquid is not particularly limited as long as it can sterilize contaminative microorganism on the web by immersion, injection, spray or the like. For example, conventionally known sterilizing liquids such as aqueous hydrogen peroxide, electrolyzed acidic water or the like are exemplified.

Though the web in the present invention is not limited in particular, known laminated packing materials comprising a paper sheet layer for maintaining the rigidity of the container, an aluminum foil layer and/or a synthetic resin film layer for preventing air and microorganisms or the like from permeating into the container, a heat-sealable synthetic resin film layer and the like are exemplified. The examples of the sealing tape include conventionally known oxygen-impermeable film tape made from PET and conventionally known water-impermeable film tape made from PE, and the sealing tape is usually adhered overlappingly to one side end portion of the web face which forms the container's interior side before the sterilizing treatment in the sterilizing liquid tank.

As the above-stated first air knife, any first air knife can be used as long as it can blast the heated air at least at the whole width of the container's interior side of the web. For example, conventionally known air knife having a narrow and long opening for blowing the air off whose width is a little wider than that of the web, blasting the hot air, and being able to remove dust or the like simultaneously with removing and drying the sterilizing liquid remaining on the surface of the web is exemplified. As the first air knives, it is preferable to use a pair of air knives disposed such that they can open and close while sandwiching the transfer route of the web and blast the heated air at the whole width of both faces of the web because they can remove the sterilizing liquid from the container's exterior side of the web as well. As to blast of the heated air from the air knife, it is preferable to blast from the nearly opposite direction of the web transfer direction because the blasting speed of the heated air relatively increases. The heated air blasted by the first air knife is usually at a speed of 15~25 m/s and with a temperature of 90~110° C.

As the second air knife of the present invention, though any second air knife can be used as long as it can blast the heated air at the step portion formed by the sealing tape and the web which forms the container's interior side, and disposed upstream of the web transfer direction of said first air knife, that is, the position where the transferring web is blasted the heated air by the second air knife before it is blasted the heated air by the first air knife, it is more preferable to use the second air knife with an opening for blowing the heated air off which is so constructed that it covers the step portion widely and laterally than to use the second air knife with an opening which has a structure for blasting the heated air locally at the step portion formed by the sealing tape and the web which forms the container's interior side. In case the second air knife with a small and round opening is used, it is possible to remove the sterilizing liquid remaining at the step portion locally, however, the sterilizing liquid blasted by the second air knife forms driblets and adheres to or trickles down the surface of the web away from the step portion with considerable frequency. On the contrary, in case the second air knife having a wide opening is used and the heated air is blasted widely and laterally at the step portion formed by the sealing tape and the web which forms the container's interior side, it is possible to remove and dry the sterilizing liquid which is blasted by the second air knife to form driblets and adheres to or trickles down the surface of the web away from the step portion as well. Though the heated air blasted by the second air knife is usually at a speed of 18~28 m/s and with a temperature of 90~110° C., it is preferable to arrange the wind speed of the second air knife to be always faster than that of the first air knife in consideration of removing the sterilizing liquid pooling at the step portion completely.

Any conventionally known squeeze roller can be used as the above-mentioned squeeze roller, and squeeze rollers where one of them is a fixed roller and the other is a movable roller, as described in the Japanese Laid-Open Patent Application No. 10-114311, are preferably exemplified. The squeeze rollers usually comprise a pair of free rotating rollers, whose surface material is rubber, which can squeeze the driblets on the surface of the transferring web while sandwiching the web. Therefore, the sterilizing liquid squeezed by the squeeze rollers trickles down the surface of the web, and when the second air knife is disposed upstream of the web transfer direction of the squeeze roller, there is a possibility that the sterilizing liquid would adhere again to the step portion where the sterilizing liquid is removed by the second air knife. However, when the second air knife is disposed downstream of the web transfer direction of the squeeze roller, and upstream of the web transfer direction of the first air knife, there is no need to worry about said possibility. In consideration of these factors, it is preferable to dispose the second air knife between the first air knife and the squeeze roller for squeezing the driblets on the surface of the web. It is particularly preferable that the web and the sterilizing liquid heated by the second air knife are disposed to reach the first air knife before cooling down, and that the web heated by the second air knife is blasted by the heated air from the first air knife before cooling down. When the second air knife is thus disposed downstream, in vicinity of the first air knife, and the sterilizing liquid is removed/dried by the first air knife before the web and the sterilizing liquid heated by the second air knife cool down, it is possible to use afterheat of the second air knife and the thermal efficiency is excellent. Further, as to the blasting of the heated air by the second air knife, it is preferable to blast from the nearly opposite direction of the web transfer direction because the blasting speed of the heated air relatively increases.

It is preferable to fix the second air knife to the same rotary axis as the first air knife which can blast the heated air at the whole width of the container's interior side of the web in view of decreasing the number of parts and incidence of disorder, because the second air knife can be moved from the operating position to the waiting position simultaneously with the move of the first air knife from the operating position to the waiting poistion when the operation is suspended for cleaning. Further, it is preferable to communicatively connected the second air knife and the first air knife which can blast the heated air at the whole width of container's interior side of the web with a common blast pipe or the like in view of decreasing the number of parts and incidence of disorder. In controlling the wind speed and wind temperature of the first and second air knives individually, it is possible to control them individually by connecting them to individual blast pipes or the like, by adjusting the area of each blow-off opening at the first and the second air knives mutually, and by controlling the temperature individually.

Figure 2:
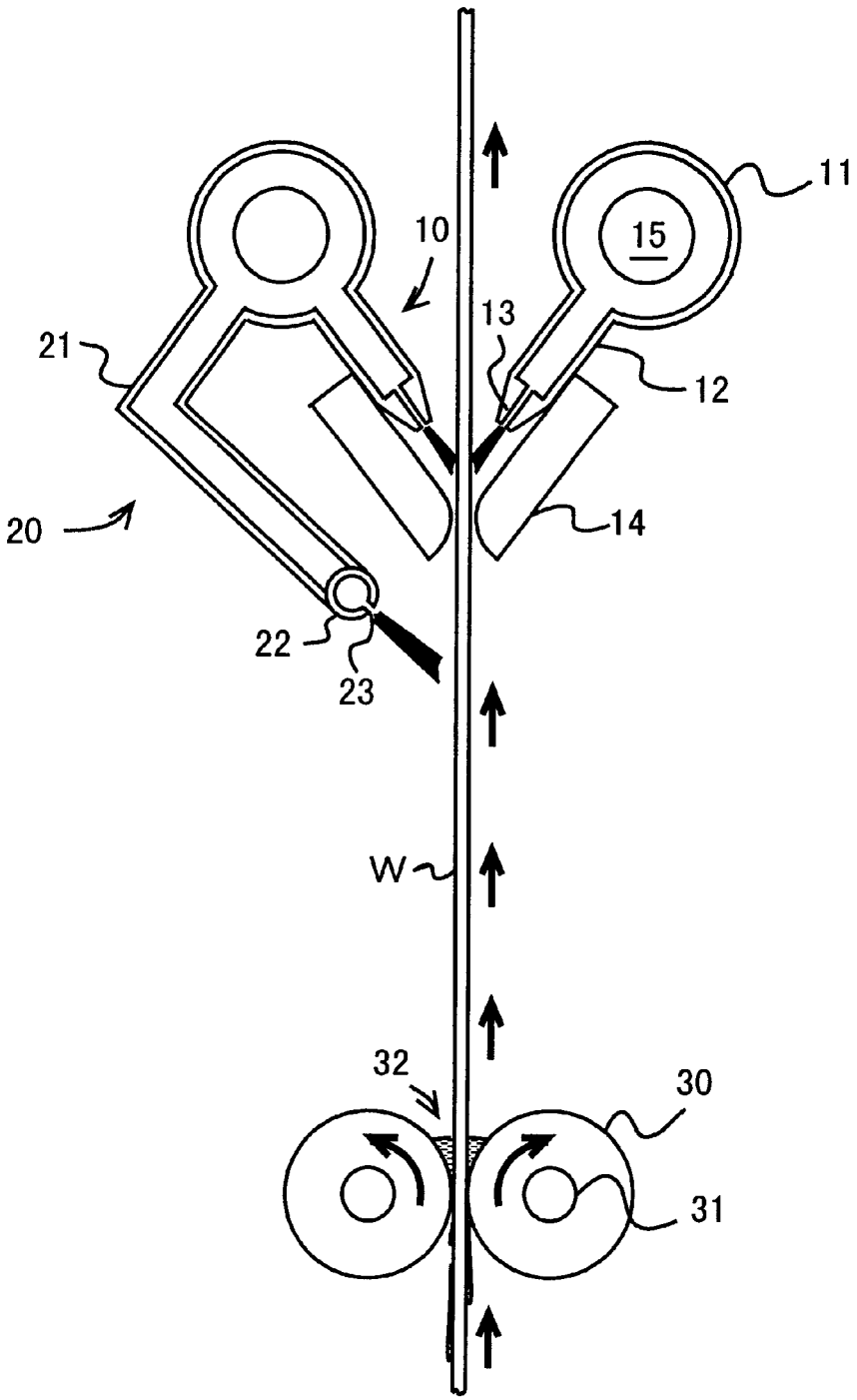
FIG. 2 is a vertical sectional view showing the sterilizing liquid remover of the present invention.
Figure 3:
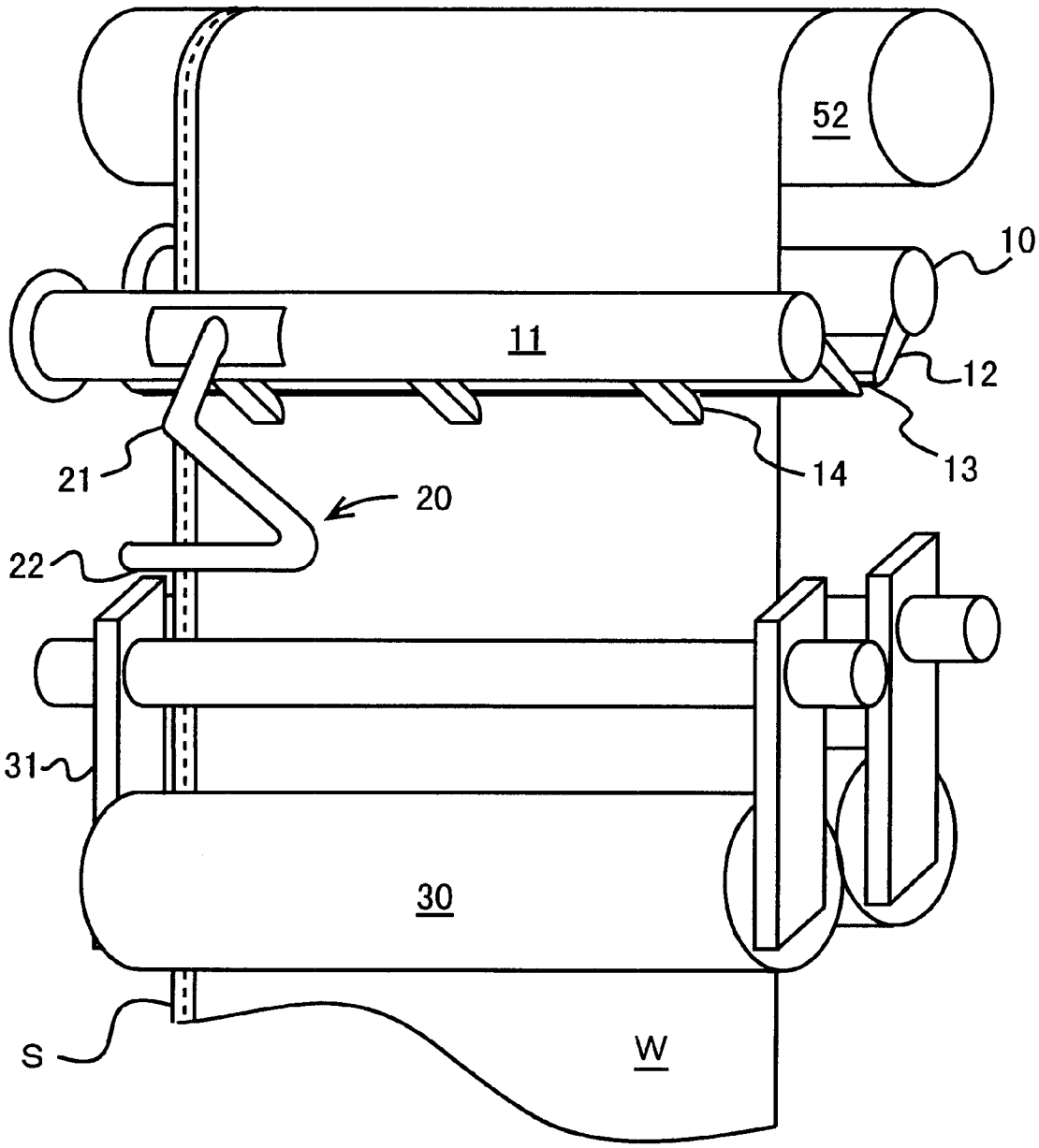
FIG. 3 is a schematic perspective view showing the sterilizing liquid remover of the present invention.
Figure 4:
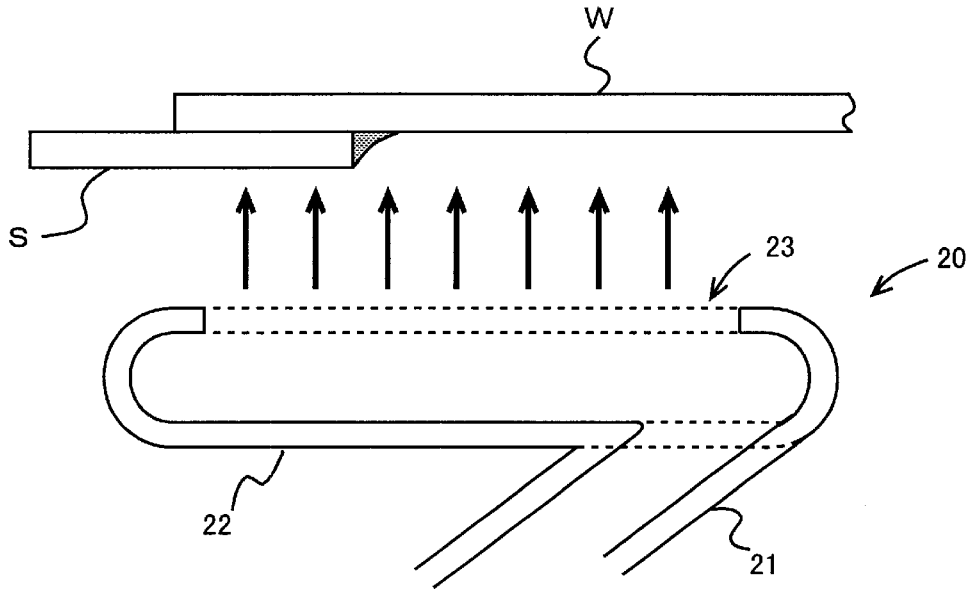
FIG. 4 is a transverse sectional view of the second air knife having a wide opening which laterally covers a step portion formed by the sealing tape and the web which forms the container's interior side.
Figure 5:
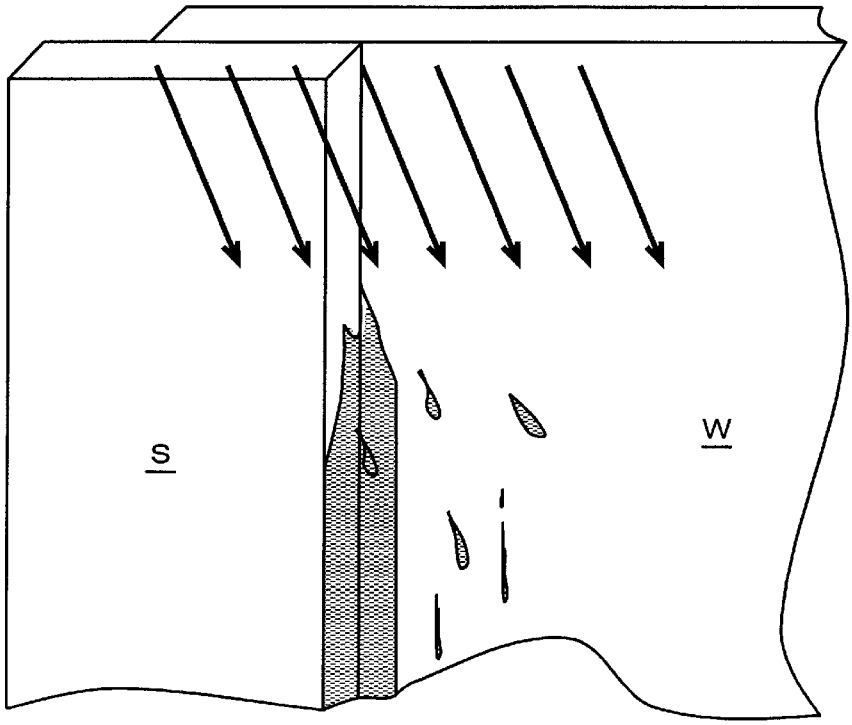
FIG. 5 is an explanatory view showing the state that the driblets blasted by the second air knife trickle down the surface of the web which forms the container's interior side.

The example of the sterilizing liquid remover of the present invention will now be described more specifically based on the drawings, but the technological scope of the present invention is not limited to the example. FIG. 1 is a vertical sectional view showing the sterilizing liquid remover of the present invention or a part of the filling/packing machine having the sterilizing liquid remover of the present invention. FIG. 2 is a vertical sectional view showing the sterilizing liquid remover of the present invention. FIG. 3 is a schematic perspective view showing the sterilizing liquid remover of the present invention. FIG. 4 is a transverse sectional view of the second air knife having a wide opening which laterally covers the step portion formed by the sealing tape and the web which forms the container's interior side. FIG. 5 is an explanatory view showing the state that the driblets blasted by the second air knife trickle down the surface of the web which forms the container's interior side.

FIG. 1 shows that the sterilizing liquid remover of the present invention having a pair of the first air knives 10, the second air knife 20, and a pair of squeeze rollers 30, is disposed in the aseptic chamber 50 which is connected/located downstream of the web transfer direction of the sterilizing liquid tank 40. In the sterilizing liquid tank 40, a web introducing opening 41, an upper web guide roller 42, a lower web guide roller 43 and the like are disposed, and the web W having the sealing tape S adhered to its side end portion, introduced from the web introducing opening 41, is guided by the upper web guide roller 42 into the sterilizing liquid tank 40, then soaked in the sterilizing liquid 44 comprised of aqueous hydrogen peroxide at a concentration of 30~35%, turned over by the lower web guide roller 43 disposed at the bottom of the sterilizing liquid tank 40, and subsequently guided to the web entrance 51 in the aseptic chamber 50. A feed roller 52 is disposed at nearly right above the web entrance 51, a press roller 54 mounted at the tip end of the vertically rocking left arm 53 is disposed near the upper end of the feed roller 52, and the web W is transferred to the next step while being sandwiched by the feed roller 52 and the press roller 54.

As shown in FIG. 2, the squeeze rollers 30 of the present invention comprise a pair of squeeze rollers having elastic surface material, and are so constructed that they can rotate freely upon the roller axis 31. This pair of squeeze rollers 30 is disposed at either sides of the web transfer route, from the web entrance 51 to the feed roller 52, and the squeeze roller 30 which is sandwiching the web W can squeeze the sterilizing liquid adhered to the surface of the web W while rotating freely. However, because the squeeze roller 30 cannot remove the sterilizing liquid completely and the web sandwiched by the squeeze roller 30 is guided upwardly, in hollow 32 at the upper part of the sandwiching portion between the pair of rollers, a pool of the sterilizing liquid is observed as shown in FIG. 2. The left squeeze roller of the squeeze rollers 30 shown in FIG. 1, which presses the side of the web W which forms the container's interior side, can rotate by the rocking arm 33 connected to the roller axis 31.

The first air knife 10 of the present invention removes the sterilizing liquid which cannot be removed by the squeeze roller 30 by blasting a hot and high-pressure air at the web W, and comprises a hollow band plate 12 projected to the radial direction from horizontal air supply pipe 11 extending parallelly to each other. The hollow of the hollow band plate 12 is connected communicatively with the interior of the air supply pipe 11, and a tip end opening of the hollow band plate is so constructed that it becomes a blow-off opening 13, and disposed at either side of the web in the downstream of said pair of squeeze rollers 30, and can usually blast the heated air with a temperature of 90~110° C. and at a speed of 15~25 m/s at the direction opposite to the web transfer direction. In the hollow band plate 12, a plurality of right and left web guides 14 are fixed at an appropriate intervals so that they suppress the rocking of the web caused by the blast of the heated air from the second air knife 20 or the like as shown in FIG. 3. The first air knife 10 and the web guides 14 can be moved from the operating position to the waiting position by rotary axis 15 disposed as axis of said horizontal air supply pipe 11.

The second air knife 20 in the sterilizing liquid remover of the present invention is constructed so that it can blast the heated air at the step portion formed by the sealing tape S and the web W which forms the container's interior side as shown in FIG. 4, and is disposed between the squeeze roller 30 and the first air knife 10 as to oppose to the web W which forms the container's interior side. As shown in FIG. 2, the second air knife 20 comprises a blow-off pipe 22, which is connected to the end portion of a bent and communicatively connected pipe 21 projected from the horizontal air supply pipe 11 in the first air knife to the radial direction, and extending parallel to the web W and to the transverse direction of the web W. This blowing pipe 22 is communicatively connected with the interior of the horizontal air supply pipe 11 through the communicatively connected pipe 21, and a blow-off slit 23 is disposed at its longitudinal direction so that it can blast the heated air widely and laterally at the step portion formed by the sealing tape S and the web W which forms the container's interior side. This blow-off slit 23 can usually blast the heated air with a temperature of 90~110° C. and at a speed of 18~28 m/s at the direction opposite to the web transfer direction, and it is so designed that the area of the opening of the blow-off slit 23 is smaller than that of the blow-off opening 13 of the first air knife, and that the wind speed of the second air knife is always faster than that of the first air knife.

Further, the second air knife 20 is disposed proximately before the first air knife 10, therefore, the web is blasted by the heated air from the first air knife while the heating effect of the second air knife is maintained, and it promotes drying of the sterilizing liquid. With this blowing off of the heated air by the second air knife 20, the sterilizing liquid which is ramaining/adhering to the step portion formed by the sealing tape S and web W which forms the container's interior side is blown off with considerable frequency, and forms driblets and adheres to or trickles down on the surface of the web away from the step portion, as shown in FIG. 5. However, as the blow-off slit 23 is formed so widely that it covers said step portion laterally, it is possible to remove/dry those blown off and adhering to or trickling down driblets as well. Further, as the second air knife 20 is fixed to the rotary axis 15, same as the first air knife 10, it is possibe to move the second air knife from the operating position to the waiting positiom simultaneously with moving the first air knife from the operating positon to the waiting positon when the operation is stopped for machine cleaning.

Effect of the Invention

The present invention makes it possible to remove/dry the sterilizing liquid which pools at the step portion formed by the web and the sealing tape, in particular, to remove/dry the sterilizing liquid blown by the second air knife by blasting the heated air widely and laterally at the step portion formed by the sealing tape and the web which forms the container's interior side by the second air knife. Because the first air knife blasts the heated air at the web heated by the second air knife before the web cools down, it is possible to promote removal/drying of the sterilizing liquid with excellent thermal efficiency. Further, in case the second air knife and the first air knife are communicatively connected by a common blast pipe or the like, it will ease machine control, such as, keeping the wind speed of the second air knife always faster than that of the first air knife, as well as decrease of the number of parts and incidence of disorder.

What is claimed is:

1. A sterilizing liquid remover for removing liquid from a surface of a web having a tape adhered at a side end portion thereof, comprising:

squeeze rollers for squeezing driblets on the surface of the web, disposed such that the squeeze rollers can open and close while sandwiching a transfer path of the web;

a first air knife to blast heated air at least to whole width of the web which forms a container's interior side, disposed downstream of the squeeze roller in a web transfer direction; and a second air knife to blast heated air at a step portion formed by the sealing tape and the web which forms the container's interior side, disposed between the squeeze rollers and the first air knives.

2. The sterilizing liquid remover according to claim 1, wherein the first air knife is a pair of air knives disposed such that the air knives can open and close while sandwiching the transfer path of the web therebetween.

3. The sterilizing liquid remover according to claim 1, wherein the second air knife has a wide opening which laterally covers the step portion formed by the sealing tape and the web which forms the container's interior side.

4. The sterilizing liquid remover according to claim 1, wherein the second air knife is disposed such that the web heated by the second air knife reaches the first air knife before cooling down.

5. The sterilizing liquid remover according to claim 1, wherein the second air knife is fixed to the same rotary axis as the first air knife which can blast the heated air at the whole width of the container's interior side of the web.

6. The sterilizing liquid remover according to claim 1, wherein the second air knife and the first air knife which can blast the heated air at the whole width of the container's interior side of the web are connected communicatively.

7. The sterilizing liquid remover according to claim 1, wherein driblets on the surface of the web and squeezed by the squeeze rollers are the driblets on the surface of the web which is introduced into a sterilizing liquid tank and soaked into the sterilizing liquid therein, and taken out of the sterilizing liquid tank.

8. A method of removing sterilizing liquid from a surface of a web having a tape adhered at a side end portion thereof, comprising the steps of:

squeezing driblets on the surface of the web by squeeze rollers disposed such that the rollers can open and close while sandwiching the web, and blasting heated air at least at whole width of a container's interior side of the web by a pair of air knives disposed downstream of the squeeze roller in a web transfer path, wherein heated air is blasted at the step portion formed by the sealing tape and the web which forms the container's interior side by an air knife disposed between the squeeze rollers and pair of air knives.

9. The method of removing the sterilizing liquid according to claim 8, wherein the heated air is blasted at the both faces of the web by the pair of air knives.

10. The method of removing the sterilizing liquid according to claim 8, wherein the heated air at a speed of 15~25 m/s and with a temperature of 90~110° C. is blasted by the pair of air knives.

11. The method of removing the sterilizing liquid according to claim 8, wherein the driblets on the surface of the web are squeezed by the squeeze rollers and then the heated air is blasted at the step portion formed by the sealing tape and the web which forms the container's interior side by the air knife.

12. The method of removing the sterilizing liquid according to claim 8, wherein the heated air is blasted widely and laterally at the step portion formed by the sealing tape and the web which forms the container's interior side by the air knife.

13. The sterilizing liquid remover according to claim 8, wherein the web heated by the air knife is blasted by the heated air from the pair of air knives before cooling down.

14. The method of removing the sterilizing liquid according to claim 8, wherein the heated air at a speed of 18~28 m/s and with a temperature of 90~110° C. is blasted by the air knife.

15. The method of removing the sterilizing liquid according to claim 8, wherein wind speed of the air knife is faster than that of the pair of air knives.

* * * * *